US006960086B2

(12) United States Patent
Bergeron

(10) Patent No.: US 6,960,086 B2
(45) Date of Patent: Nov. 1, 2005

(54) SWIM TRAINING APPARATUS AND METHOD

(75) Inventor: Jean-François Bergeron, 1230, chemin Royal, Québec (I.O.), Québec (CA), G0A 3Z0

(73) Assignee: Jean-François Bergeron, Saint-Laurent (CA)

( * ) Notice: Subject to any disclaimer, the term of this patent is extended or adjusted under 35 U.S.C. 154(b) by 258 days.

(21) Appl. No.: 10/287,793

(22) Filed: Nov. 5, 2002

(65) Prior Publication Data

US 2004/0086839 A1 May 6, 2004

(51) Int. Cl.[7] ..... A63B 69/12
(52) U.S. Cl. ..... 434/254; 434/247; 482/55; 441/55
(58) Field of Search ..... 434/247, 254; 441/55, 133; 482/55; 4/505

(56) References Cited

U.S. PATENT DOCUMENTS 4,693,570 A 9/1987 Kryder
5,141,440 A * 8/1992 Wallingford ..... 434/254
5,330,378 A * 7/1994 Park ..... 441/133
5,540,591 A 7/1996 Doane
5,603,676 A 2/1997 Cymbalisty
5,938,565 A 8/1999 Bernacki
6,086,379 A 7/2000 Pendergast et al.
6,142,912 A 11/2000 Profaci
6,216,629 B1 * 4/2001 Straub ..... 116/209
6,331,129 B1 12/2001 Earley

FOREIGN PATENT DOCUMENTS

GB 2 293 677 4/1996
JP 08238332 A * 9/1996 ..... A63B/17/00
WO WO 85/03881 9/1985

* cited by examiner

*Primary Examiner*—Derris H. Banks
*Assistant Examiner*—Dmitry Suhol
(74) *Attorney, Agent, or Firm*—Brouillette Kosie Prince

(57) ABSTRACT

A swim training apparatus has been designed to help swimmers of any age or any type of experience by teaching the right swimming techniques, correcting their swimming bad habits, and enhancing their swimming capabilities. The apparatus is destined to be used under water in a swimming pool or in a natural basin of water and it consists of a plurality of under water steps which are equipped with reference markers.

22 Claims, 6 Drawing Sheets

SWIM TRAINING APPARATUS AND METHOD

FIELD OF INVENTION

A swim training apparatus has been designed to help swimmers of any age or any type of experience by teaching the right swimming techniques, correcting their swimming bad habits and enhancing their swimming capabilities. The apparatus is destined to be used under water in a swimming pool or in a natural basin of water.

BACKGROUND OF THE INVENTION

Swimming can be part of everybody's life at one time or the other. It is practiced as a recreational activity, as an emergency measure in case of an accident happening in water, or during a swimming competition. The basics of swimming is usually learned at home and can taught by unprofessional swimmers or by basic public courses.

To perfect their swimming techniques, some swimmers may want the supervision of a professional trainer or swimmer, who can teach the specific techniques of body motion and respiration in order to reach a higher level in the art of swimming.

In order to teach swimming in a the most effective way, the trainer needs to have a good visual image of his/her trainee as he/she executes the swimming motion. The trainer also needs to move as the swimmer progresses in a lap or possess the tools to allow him/her to follow and analyze the swimmer's progression during a swimming exercise. On the other hand, the swimmer will require guidance and explanations from the teacher to clearly understand the good practices. With time and lots of practice, swimming reflexes are created in his/her mind, which helps him/her anticipate the swimming exercise in terms of body movement precision, speed, pace, effort and duration.

In the past, many devices and apparatus have been designed to help the swimmer learn how to swim or to enhance his/her swimming techniques. The first series of apparatuses consists of swim training systems to be used above or out of water. For instance, Profaci (U.S. Pat. No. 6,142,912), Cymbalisty (U.S. Pat. No. 5,603,676) and Doane (U.S. Pat. No. 5,540,591) have defined different types of machines allowing to simulate the swimming motions and to reproduce some of the forces that are felt by the swimmer during his/her swimming exercise. Even though these machines may enhance the monitoring capabilities of the trainer and allow him/her to share advices in real time to the swimmer, the swimmer can only react to the comments of the trainer, he/she also cannot adjust his/her moves with reference markers and only has a simulation of real water condition. Thus, the habit so created do not include all the same parameters as a real life swim into water.

A second group of invention have integrated the use of computers in training program systems. Indeed, Bernacki (U.S. Pat. No. 5,938,565) has created a system linking the swimmer to a computerized machine with the use of a cable which induces a cable tension according to the required degree and type of training. Even though the performances of the swimmer may be enhanced, the visual reference markers are missing in water and the use of this apparatus doesn't involve any form of teaching with respect to body motion of the swimmer. In Pendergast et al. (U.S. Pat. No. 6,086,379), the visual reference is added with the help of a special pair of goggles which emit a light that should set the required pace of the swimmer, depending on the selected training. In this case, even if the visual reference is there, the swimmer can still only wait for the next light to set the pace he/she should be aiming at, but he/she cannot visually anticipate the set goal as he approaches it during his/her swimming exercise.

Another type of invention includes motion training system in water with the aid of a visual reference. Kryder (U.S. Pat. No. 4,693,570) has elaborated a system of mirrors, located at different places and at different depths in a pool. This system allows the swimmer and the trainer to visualize the motion of the swimmer from different angles and allows a real-time motion correction possibility for the swimmer. However, this system lacks the pace visual marker, lacks the teaching possibility of the right body motion and it is also preferably installed in pools.

There is therefore a need for a swim training system offering real-time visual references to the swimmer allowing him/her to anticipate the course and the execution of a typical swimming exercise.

There is furthermore a need for a swim training system which allows a teacher to monitor the swimmer during a swimming practice in order to establish the required pace of the swimmer and give advices regarding the body motion techniques with respect to a reference which is visually available, physically reachable and easy to anticipate to the swimmer.

There is also a need for a system to help develop the swimmer's swimming techniques and reflexes during different type of swimming practice.

There is finally a need for an easy to install and inexpensive apparatus to be used in any water source or type of pools.

SUMMARY OF INVENTION

The object of this invention is to provide an innovative swim training apparatus destined to help new swimmers, correct the swimmers bad habits or enhance the swimming capacities of more experimented swimmers.

This invention involves a swim training apparatus with visual and/or tactile reference markers for any type of swimmers and their trainer. It is designed to set physical objectives to be reached at different intervals during a swimming exercise, to set a pace of strokes for various types of swims, to position the localization of the swimmers body parts with respect to a fixed point of reference, to help generate a real-time motion habit to the swimmer, and to be adaptable to the swimmer's size, to also be adaptable as the swimmer's performance increase and to the different water conditions.

In a preferred form, the apparatus is fabricated with a ladder like configuration comprising longitudinal cords and lateral steps, and the apparatus is preferably fixedly installed at the bottom of a pool or of a water basin. The extremities of the apparatus are also fixedly attached to the lateral side of a pool or to a support structure in water. The reference markers are positioned on every predetermined number of lateral steps.

There is therefore provided a swim training apparatus for under water use comprising:

- a first support member having a first depth, a first length and extremities and which extends in the swimming direction;
- a second support member having a second depth, a second length and extremities and which extends in the swimming direction;

lateral step like members which are generally perpendicularly connected to the said first support members and to the said second support member;

markers which are located on the said lateral step like members.

When needed, stabilization members which extend longitudinally in the swimming direction may also be used.

In a preferred embodiment, said first and said second support members can be cords. Similarly, said stabilization members can also be cords.

Lateral step like members may also support said markers adapted to be seen by the swimmer.

Along the longitudinal length and at both ends of the first support member and the second support member, anchor structures are positioned in order to provide a controlled positioning of the apparatus into water and also offer vertical adjustment means for the use of the apparatus by any type of swimmer.

There is furthermore provided a method for a swimmer using a swim training apparatus, wherein said swim training apparatus comprises two sets of support members having a longitudinal axis extending in the swimming direction, lateral step like members which are perpendicularly connected to the two sets of support members and wherein some of the said lateral step like members support markers, which are located at a predetermined interval on the said lateral step like members, and wherein two consecutive markers determine part of a stroke cycle or a traction cycle which are achieved by a complete arm rotation of the said swimmer, and wherein the said arm rotation represents the complete arm movement which is repeated in a specific swimming exercise in order to produce swimming traction, the said method comprising the following steps:

a) visualization of said markers;

b) positioning of said swimmer's body generally centrally with respect to said longitudinal axis of said two sets of support members;

c) positioning of the swimmer's arm near said marker at a predetermined optimal arm extension and at predetermined optimal position during said arm rotation;

d) adaptation of said arm rotation rate in order to attain said marker and complete said traction cycle;

e) positioning of said swimmer's hand on or near said marker or said lateral step like member which supports said marker;

f) completion of said traction cycle;

g) anticipation of the next marker.

There is furthermore provided a swim training method comprising the step of organizing and dividing the aquatic space where a swimmer swims with the use of an apparatus comprising two sets of support members having a longitudinal axis extending in the swimming direction, lateral step like members which are perpendicularly connected to the two sets of support members.

Other aspects and many of the attendant advantages will be more readily appreciated as the same becomes better understood by reference to the following detailed description and considered in connection with the accompanying drawings in which like reference symbols designated like elements throughout the figures.

The features of the present invention which are believed to be novel are set forth with particularity in the appended claims.

DETAILED DESCRIPTION OF A PREFERRED EMBODIMENT

Usually, the help of a swimming trainer or the use of swim aids provides a good solution for the swimmer who is looking to enhance his/her swimming abilities, which can range from learning how to swim, to perfecting one's swim technique at a competition level.

The invention described herein presents such a swim aid which, when combined to the monitoring and the good advices of a professional swim trainer, can offer a substantial opportunity to the swimmer to improve his/her swimming techniques. For the benefit of the invention described herein, swim lengths correspond to the pool length measured in-between pool walls which is swam by the swimmer or will simply consist of the distance the swimmer swims before he/she turns or changes directions.

Figure 1:
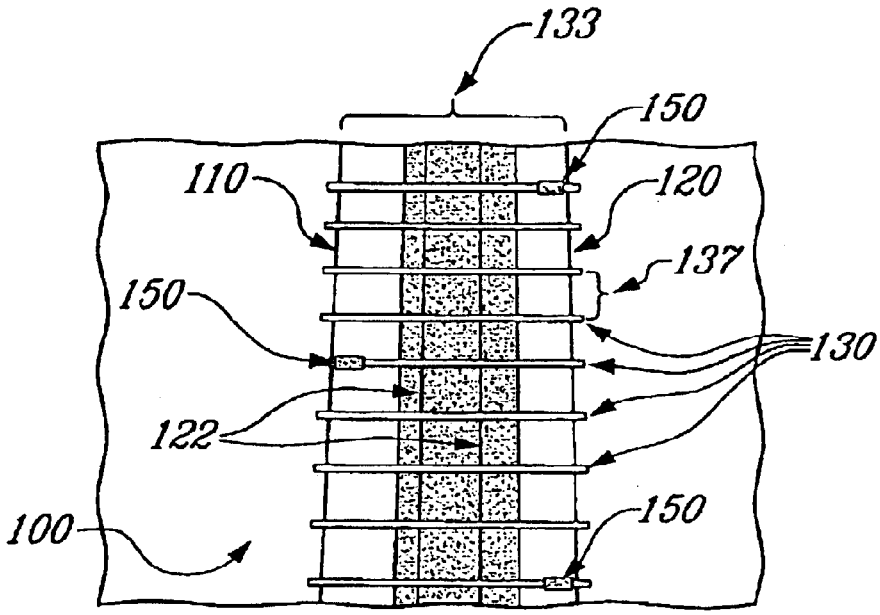
FIG. 1 is a top view of a swim training apparatus in accordance with the invention.
Figure 2:
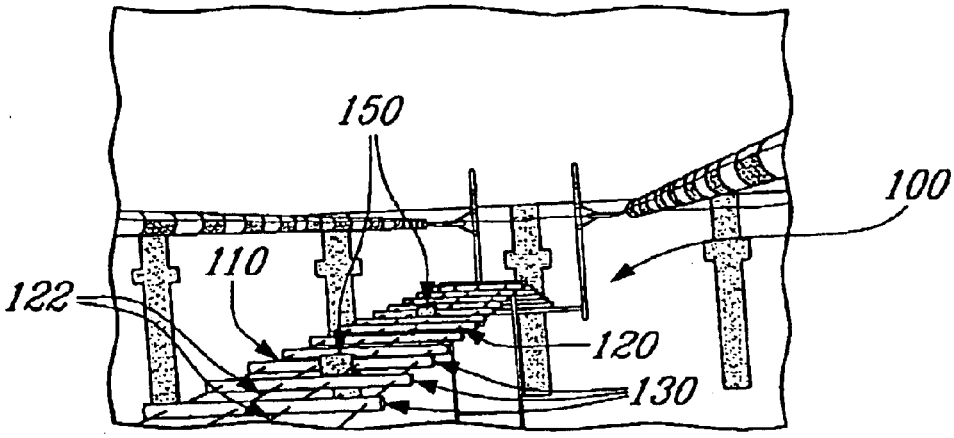
FIG. 2 is an isometric under, water view showing the swim training apparatus shown in FIG. 1.

FIGS. 1 and 2 illustrate a swim training apparatus 100 positioned under water at a depth which is selected depending on the swimmer's size. A younger or small person will use the apparatus at a level which is usually shallower than the level chosen for a tall person or an adult. Along the swimming direction, the swim training apparatus 100 preferably comprises at the same water level a right cord 110, a left cord 120, stabilization cords 122 and lateral steps 130 (only some are shown). The "cords" (110, 120 and 122) are preferably made of an appropriate flexible and non-corrosive material and can have any required length. However, the "cords" (110, 120 and 122) could be made of rigid or semi-rigid materials. The lateral steps can be moved longitudinally throughout the entire length of the cords (110, 120 and 122) and are adapted to be fixed relative to the cords at a predetermined interval to provide means to establish the desired swim stroke cycle.

The distance between the left cord 110 and the right cord 120 more or less delimits the lateral span 133 of the apparatus 100. Two consecutive lateral steps 130 define a step increment 137 and at every pre-determined number of step increments 137, a reference marker 150 is located on the lateral step according to the pace objectives of the swimmer.

The reference marker 150 consist of a visual indicator which can be seen by the swimmer along the swim lengths. Since they are located at every selected number of step increments 137 and depend on the selected type of training, the markers 150 impose a stroke rate with the same traction distance to cover in between two consecutive markers 150. In the crawl swim for instance, a stroke consists of a full arm rotation around a more or less lateral axis with respect to the swimmer's body. According to the current embodiment, when the same arm position is reached for each stroke, the markers 150 should be in the vicinity of the hand of the swimmer.

The "under water parts" (110, 120, 122, 130 and 150) of the apparatus 100 are preferably designed to generally have the same density as the water's density. By doing so the flotation characteristics of the apparatus 100 will help its stabilization into water, since the apparatus 100 will sensibly behave as if it is suspended in water.

Figure 11:
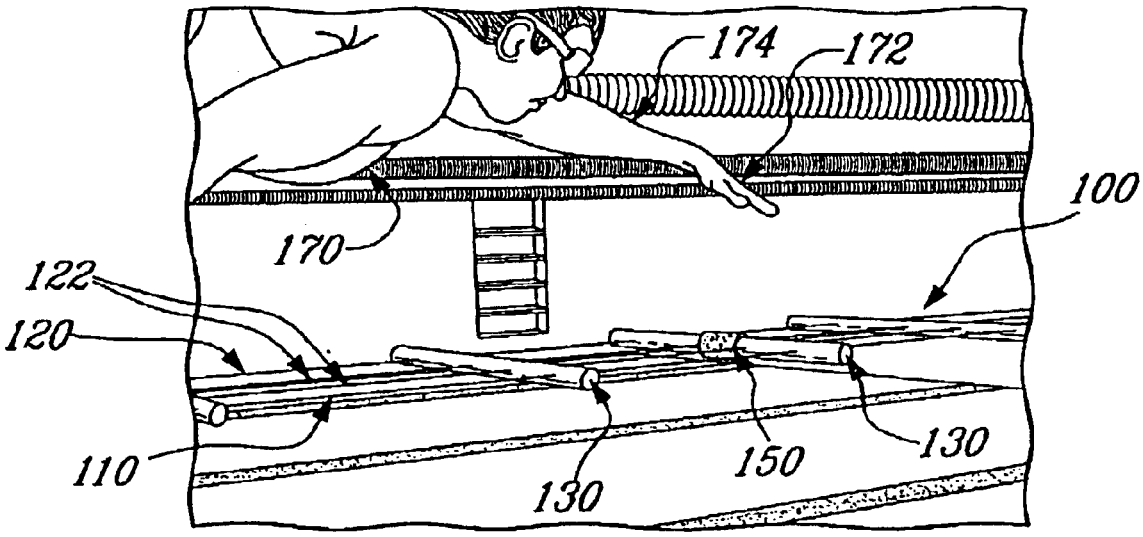
FIG. 11 is an isometric view showing a swimmer using the swim training apparatus of FIG. 1.

A method of stroke movement is illustrated in FIG. 11. During a crawl stroke, the rotating arm 174 is supplying part of the required power to make the swimmer 170 progress in his/her swim lengths. At the moment the swimmer 170 positions his/her arm 174 in extension as it enters the water, the reference marker 150 is near the swimmer's hand 172. As the swimmer 170 continues his/her arm rotation movement, his/her hand 172 reaches the marker's 150 level or the lateral step 130 which supports the marker 150. A child will better understand the requirement of touching the marker 150, but a more experienced swimmer will mostly use the marker 150 as a hand position reference.

Figure 12:
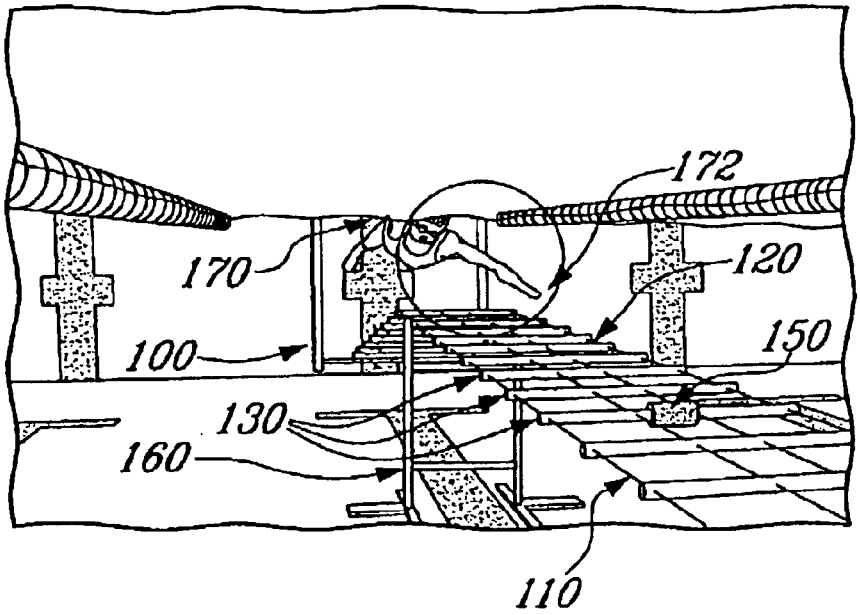
FIG. 12 is an isometric view showing a swimmer with a bad swimming technique which could be corrected using the swim training apparatus of FIG. 1.

FIG. 12 illustrates what happens when a learning swimmer 170 swims without a good technique and does not follow the swim training apparatus 100. During the crawl stroke, the swimmer's left hand 172 is deported away from its optimal trajectory which consist in the area of the left cord 120 and the lateral step 130 supporting the marker 150. The swim training apparatus also acts as a reference to the swimmer in order to help him/her position his/her body with respect to the longitudinal direction of the apparatus 100.

There are different ways of having the reference marker 150 being reached by or reacted by the swimmer 170. In a first embodiment shown in FIG. 1, the markers 150 are located at every five lateral steps 130, but alternate their location from the left to the right of the selected lateral steps 130. This embodiment suits inexperienced swimmers to whom the view of the reference marker 150 will help position the hands of the left and right arm to an optimal location with respect to their body. FIGS. 2 and 11 show another embodiment where the apparatus 100 still possesses markers 150 at every selected number of step increments 137, but are located at the center of those lateral steps 130. This embodiment can be used for crawl swimmers who only needs a visual reference or for any other type of swims involving a combined central hand movement like breast stroke or butterfly stroke training for instance.

As the swimmer gets more experienced, his/her trainer or himself/herself may decide to increase the number of step increments 137 between each markers 150, in order to impose a higher efficiency to the swimmer. The swim lengths will then be covered with a lesser number of strokes.

The trainer watches his/her pupil as he/she performs his/her swim lengths and monitor the technical movements involving all body parts, when they are in and out of water. However, the in-water body motions are harder to see for the teacher when he/she is outside of the pool. Also, a experimented swimmer knows how to position and move his/her body in water and may be able to tell people about it, but a swim teacher needs to communicate his/her knowledge in a language that is easily understandable and which generates mental references for the swimmer. The swim training apparatus 100 comprises markers 150 which act as visual references to the swimmer and which, at the same time, help the trainer teach about the arm and hand movement involved in each stroke. The mental images involving the body motions gets in the mind of the swimmer in a quicker and easier way when the under water space is divided and organized with such an apparatus 100. On top of that, the swimmer's physical memory is developed by the application of a muscular force on the markers 150 of the apparatus 100. Since the markers 150 are reached many times during a swim length, this physical memory enables the swimmer to develop physical muscular reflexes that remembers him/her how to position his/her arm and hand at a specific moment in each stroke. The markers 150 also provide a visual and fixed reference point for the trainer in order to evaluate the stroke rate and monitor the body motions of the swimmer.

On top of offering a visual reference, the markers 150 provide the swimmer with means to anticipate the next goal to attain and the level of effort that will be required to achieve it. A direct real-time evaluation of the distance to the next marker 150 helps the swimmer gage the required efforts during the course of the swimming exercise and develop the swim reflexes.

This invention is particularly useful for children as it helps develop the mental image of their body motions with respect to visual references directly into water and in real-time, since younger aged people usually experience more difficulties transposing an illustrated or explained principle, when it is presented out of its physical context, to the real practice of that same principle. For instance, a swim technique is harder to explain to a child outside of water, even if equipments are involved, than inside of water with real visual and physical references.

The reference markers 150 physical aspect and functions can adopt various forms. In the preferred embodiment, the markers 150 are made of small colored plastic tubes which are easily noticed by the swimmer of any age. The chosen material can be of any type or shape, as long as it is corrosion protected and that it is mechanically adaptable to the lateral steps 130.

The markers 150 are laterally located on the steps 130 to accommodate the swimmer's need and experience. In other embodiments, the markers could comprise a sensor system of lights being activated at the passage of the hand during a stroke or simply provide a visual signal to the swimmer. A computerized system could also be incorporated to those embodiments in order to acquire position, speed and acceleration data.

Figure 3:
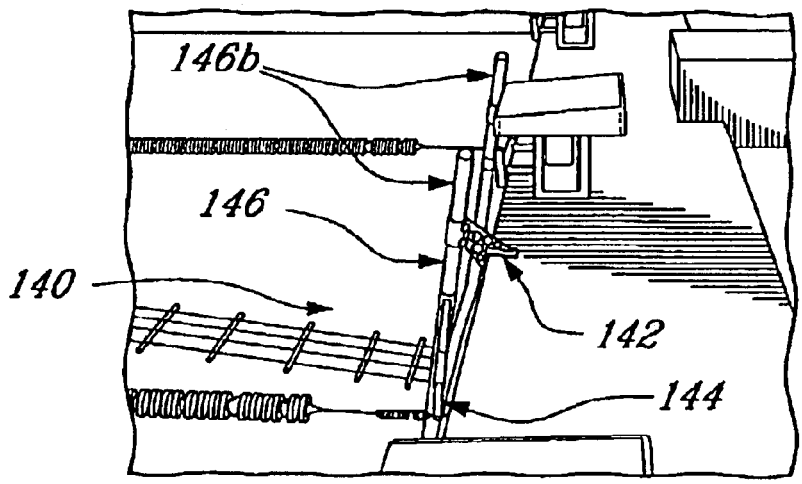
FIG. 3 is a side view showing the above water anchor structure of the swim training apparatus shown in FIG. 1.
Figure 4:
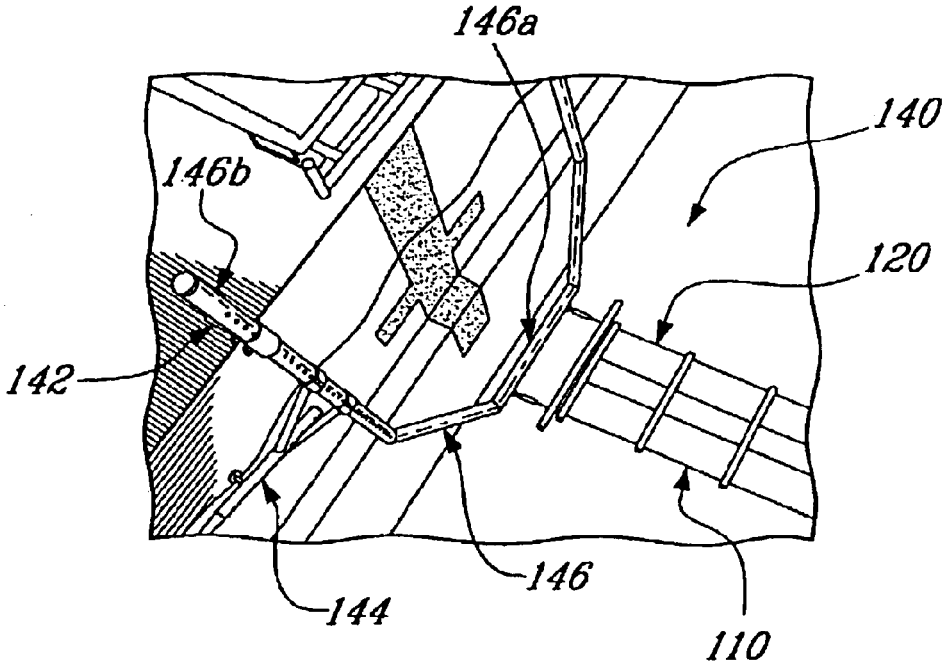
FIG. 4 is a top view showing the above water anchor structure of the swim training apparatus shown in FIG. 1.
Figure 6:
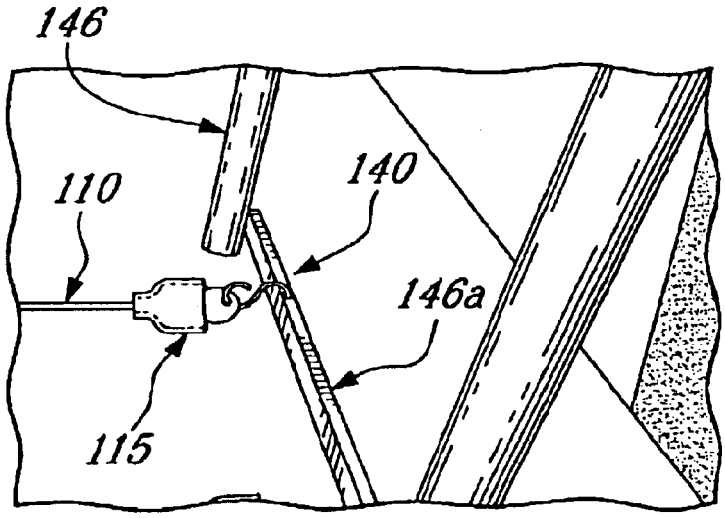
FIG. 6 is a side view showing the way the under water cords connect to the above water anchor structure shown in FIGS. 3 and 4.

FIGS. 3 and 4 show one of the possible embodiments of the end anchor structures 140, which tension and position the cords (110 and 120) of the swim training apparatus 100. It consist of a vertical U shaped non-corrosive member 146 which is longitudinally in line with the under water parts of the apparatus 100. The U shaped member 146 is firmly attached with braces (142 and 144) to the side of a pool, to a deck or to any other structures in the water, in such a way to still allow the swimmer to dive, start his/her swim lengths or turn during a lap. In order to add vertical adjustability to the apparatus, the U shaped members 146 also comprise vertical adjustment means (not shown), like a telescopic mechanism or it can be positioned at different locations relative to the fixed braces (142 and 146). The bottom portion 146*a* of the U shaped member 146 connects to the right cord 110 and to the left cord 120. A detailed view of the connection is illustrated in FIG. 6, where an attaching device 115, incorporating an elastic, a spring or any other tension mechanism, offers tensioning means and connects each cord (110 and 120) to the bottom portion 146*a* of the U shaped member 146.

The U shaped member 146 of the end anchor structure 140 is designed to provide enough space and wall surface (if available) to the swimmer as he/she turns at the end of a swim length. The swimmer then needs to readapt his/her cadence and body motion to the selected pace of markers 150. After turning around himself/herself in a pool used for a competitive swim exercise, the swimmer needs to optimally cover an under water distance before going back to the water surface. In one of the embodiments, the reference markers 150 are removed near the end anchor structure 140, and the first marker 150 the swimmer sees after turning at the end of the swim lengths offers the indication that the required optimal under water distance has been covered. Another embodiment of the apparatus 100 comprises all the reference markers 150, spaced away from each other as described in the preferred embodiment, but one of the reference marker (not shown) is physically different than the others and indicates to the swimmer that he/she should readapt his/her above surface swim cadence with the markers 150.

The end anchor structures 140 can be designed with various shapes, any non-corrosive materials and any member configuration, as long as it provides an under-water connecting interface for the apparatus 100 and also, avoids disrupting the swimmer's body motions.

In the preferred embodiment, the end anchor structure 140 comprises a U shaped member 146 having its extremities sticking out of water, in order to provide attachment areas 146*b*. For instance, these attachment areas 146*b* may be used as a support for cords (not shown) running along the apparatus 100 at an above water level.

For other swim types like the back stroke, the above water cords (not shown) therefore provide a visual reference to the swimmer which may include a visual reference marker system (not shown) that could be used as a body motion guide and as an arm stroke rate reference, with a similar method as the one presented for the crawl swim in the preferred embodiment. The recovering movement involved in the back stroke consists of the arm rotation movement which happens out of water. Offering such a visual reference to the swimmer to perform an optimal recovering movement, generally ensures a better and more efficient traction movement.

Figure 7:
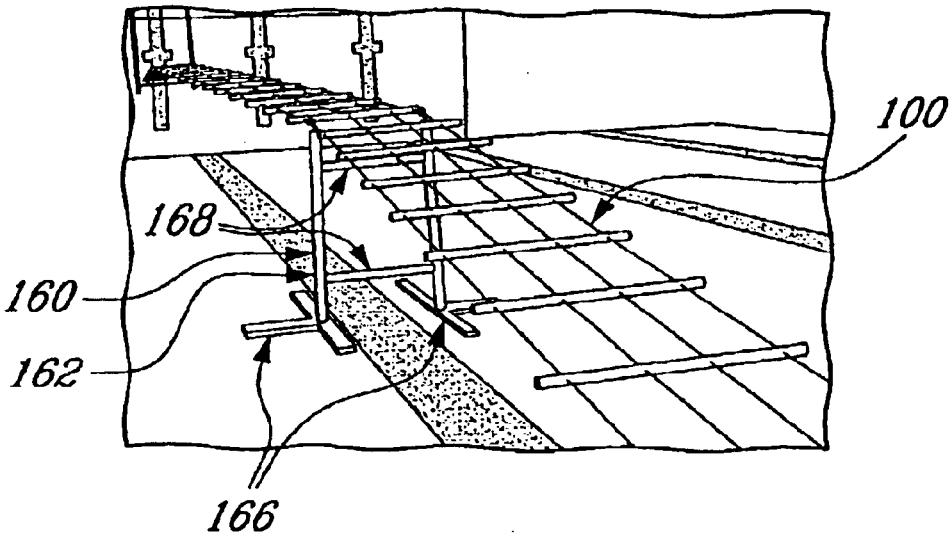
FIG. 7 is an isometric view showing the swim training apparatus under water parts of FIG. 1 interfacing with the shallow under water anchor structure.
Figure 8:
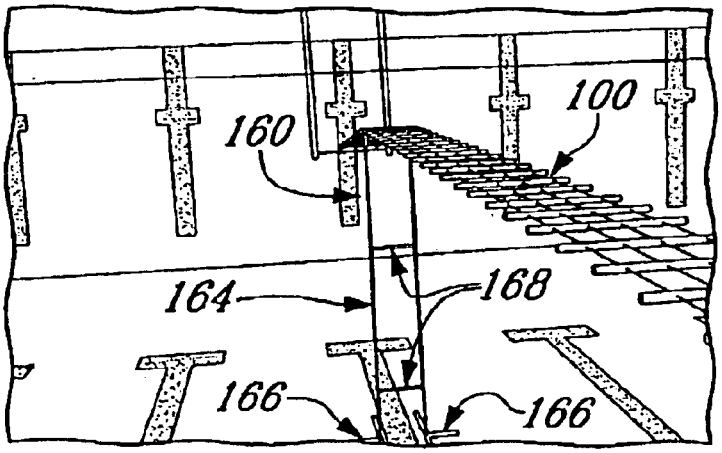
FIG. 8 is an isometric view showing the swim training apparatus under water parts of FIG. 1 interfacing with the deep under water anchor structure.

On top of those end anchor structures 140, bottom anchor structures 160 help to vertically position and also maintain the same longitudinal level of under water depth for the swim training apparatus 100, as seen in the embodiments of FIGS. 7 and 8. Each bottom anchor structure 160 comprises telescopic vertical members (162 for shallow water or 164 for deeper water) which connect to the left cord 120 and right cord 110. Since all kinds of swimmers come in various body size or shape, the swim training apparatus 100 needs to provide a vertically adjustable feature. The telescopic vertical members are also adaptable to any depth of pools, as it is usually needed in a standard pool having a shallow portion and a deeper portion.

The number of bottom anchor structure 160 is chosen to ensure the complete lateral stabilization of the apparatus, and are preferably positioned at a constant distance along the longitudinal length of the apparatus, although any location of the bottom anchor structures 160 can laterally stabilize the apparatus 100. Lateral braces 168 and feet 166 provides stability and rigidity to the two telescopic vertical members (162 or 164). In a preferred embodiment, the bottom anchor structure's density is higher than the water's density, in order to prevent any movement of the bottom anchor structure 160 with respect to the water and also prevent the need to fixedly attach each bottom anchor structure 160 to a fixed structure. This functionality allows a variety of bottom anchor structure 160 shape and size to be adapted to any bottom surface of any kind of pool or water basin and still prevent any kind of damages.

In another embodiment (not shown), the bottom anchor structure 160 could incorporate weights to a member structure which, when combined with the use of the proper tension in the right cord 110 and the left cord 120, would stabilize and help maintain the position of the swim training apparatus 100, without the use of feet 166.

Figure 9:
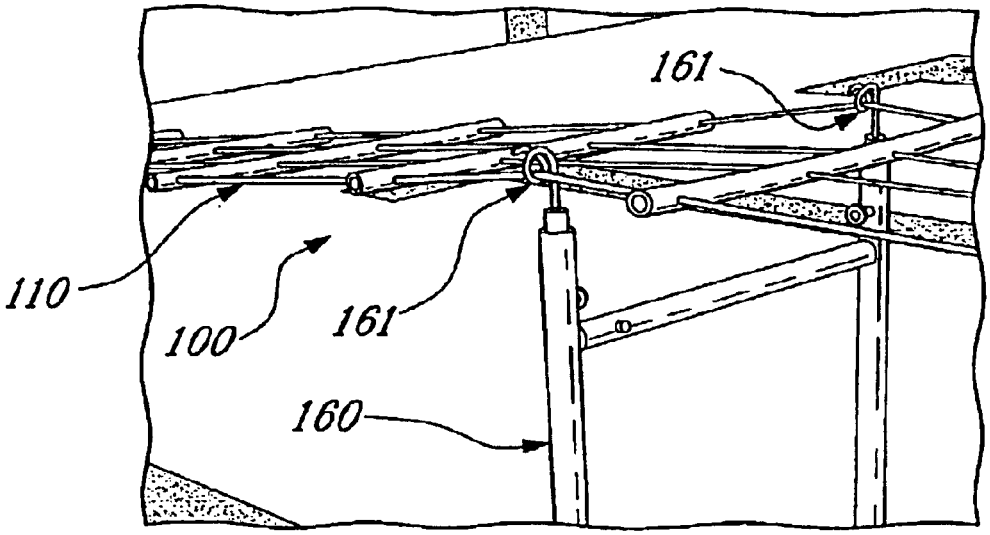
FIG. 9 is an isometric view showing the swim training apparatus under water parts of FIG. 1 connecting with the under water anchor structure.
Figure 10:
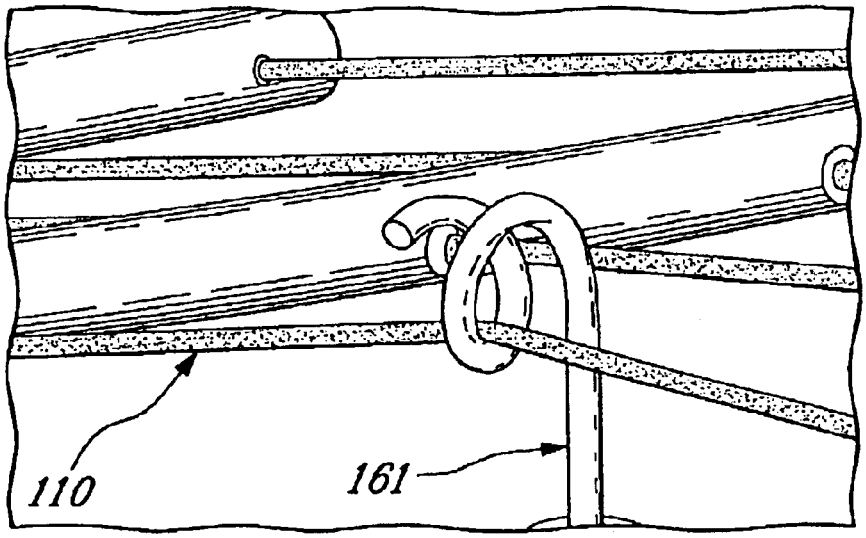
FIG. 10 is a detail view showing into more details one possible connection between the cords and the under water anchor structure.

The bottom anchor structures 160 also provides means to attach themselves to the left and right cords (110 and 120), as illustrated in FIGS. 9 and 10. In the preferred embodiment, a connector 161 is positioned at both vertical extremities of the bottom anchor structure 160. Each connector 161 is made of a bar member which is formed in a spiral shaped at one of its extremity and which has its axis in the same longitudinal direction as the left and right cords (110 and 120). The other extremity of the connector 161 is fixed to the bottom anchor structure 160. Any other attachment means of any shape or size, made from any non-corrosive material could be used as a connector 161, as long as it gives the same advantages of the spiral shaped connector 161, by providing a quick and easy under water installation of the swim training apparatus 100, by offering a very low risk of injuries to the swimmer as he/she performs his/her arm strokes, while still being a very inexpensive solution.

Figure 5:
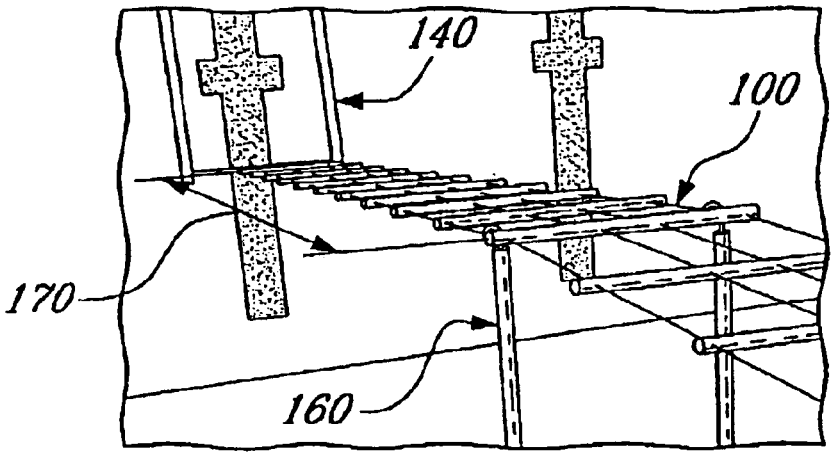
FIG. 5 is an isometric view showing the swim training apparatus under water parts interfacing with the under water anchor structure an the above water anchor structure shown in FIGS. 3 and 4.

FIG. 5 shows how a swim training apparatus 100 anchors itself at one side of the pool with the end anchor structure 140. Every time a predetermined distance is covered along the longitudinal direction of the apparatus 100, a bottom anchor structure 160 is added to hold and stabilize the apparatus 100 at the selected water level which depends on the swimmer's size and shape.

The distance between the end anchor structure 140 and the first bottom anchor structure 160 that is found along the length of the apparatus 100 defines a depression zone 170. When the swimmer is in the process of flipping at the end of the swim lengths, he/she needs more vertical space than the provided swim space (not shown) between the water level and the under water level where the apparatus 100 is positioned. To generate the depression zone 170, the attaching device 115 and the bottom portion 146*a* of the U shaped member 146, illustrated in FIG. 6, need to be positioned at a lower under water level (not shown) than the under water level where the apparatus 100 is positioned. When the apparatus 100 is looked at in a lateral direction, the depression zone 170 essentially consist of a slope created by the portion of the cords (110 and 120) joining each end anchor structure 140 to their closest anchor structure 160. The selected slope degree is chosen by the trainer depending on the swimmer's size, shape and experience, and the end anchor structures 140 and the bottom anchor structure provide the vertical adjustability to obtain any desired slope.

While a preferred embodiment of the invention has been described herein, it should be apparent to those skilled in the art that variations and modifications are possible without departing from the spirit of this invention.

What is claimed is:

1. A swim training apparatus for under water use extending in a swimming direction comprising:

a first support member having a first depth, a first length and extremities and which extends in the swimming direction;

a second support member having a second depth, a second length and extremities;

lateral step like members which are generally perpendicularly connected to the said first support member and to said second support member and extend in the swimming direction;

markers which are located on said lateral step like members.

2. An apparatus as claimed in claim 1, wherein each of the said extremities of said first support member and said second support member are connected to anchor structures which maintain said first depth and said second depth of said first support member and said second support member.

3. An apparatus as claimed in claim 2, wherein each said anchor structure and each of said extremities of said first support member and said second support member are connected to each other with tensioning means.

4. An apparatus as claimed in claim 2, wherein each said anchor structures are vertically adjustable.

5. An apparatus as claimed in claim 2, wherein said anchor structures comprise bottom anchor structures and end anchor structures.

6. An apparatus as claimed in claim 5, wherein the said bottom anchor structures are vertically adjustable.

7. An apparatus as claimed in claim 5, wherein the said bottom anchor structures are generally disposed at a predetermined spacing along said first and second length of said first support member and second support members.

8. An apparatus as claimed in claim 6, wherein the said anchor structures generally have a higher density than water density.

9. An apparatus as claimed in claim 6, wherein each of the said end anchor structure maintains said first and second depth at a first level, and wherein each said bottom anchor structure maintains said first and second depth at a second level, and wherein said first level is deeper than said second level.

10. An apparatus as claimed in claim 1, wherein the said apparatus further comprises stabilization support means which extend in the swimming direction.

11. An apparatus as claimed in claim 1, wherein the said first depth and the said second depth are the same.

12. An apparatus as claimed in claim 1, wherein the said lateral step like members are disposed at a predetermined spacing along the said first and second length of the said first and second support members.

13. An apparatus as claimed in claim 1, wherein the said markers are disposed at a predetermined interval of number of said lateral step like members.

14. An apparatus as claimed in claim 13, wherein the said markers are located at the center of the said lateral step like members.

15. An apparatus as claimed in claim 13, wherein said step like members have a right side and a left side and the said markers alternate their location from the said left side to the said right side or from the said right side to the said left side.

16. An apparatus as claimed in claim 13, wherein the said markers consist in a colored visual indicator.

17. An apparatus as claimed in claim 13, wherein the said markers consist in a body motion sensor system.

18. An apparatus as claimed in claim 13, wherein the said markers consist in a light emitting system.

19. An apparatus as claimed in claim 1, wherein the said apparatus generally has the same density as water density.

20. An apparatus as claimed in claim 1, wherein density of the apparatus is equal or less than water density.

21. A method for a swimmer using a swim training apparatus, wherein said swim training apparatus comprises two sets of support members having a longitudinal axis extending in a swimming direction, lateral step like members which are perpendicularly connected to the two sets of support members and wherein some of the said lateral step like members support markers, which are located at a predetermined interval on the said lateral step like members, and wherein two consecutive markers determine part of a stroke cycle or a traction cycle which are achieved by a complete arm rotation of the said swimmer, and wherein the said arm rotation represents the complete arm movement which is repeated in a specific swimming exercise in order to produce swimming traction, the said method comprising the following steps:

a) visualization of said markers;

b) positioning of said swimmer's body generally centrally with respect to said longitudinal axis of said two sets of support members;

c) positioning of the swimmer's arm near said marker at a predetermined optimal arm extension and at predetermined optimal position during said arm rotation;

d) adaptation of said arm rotation rate in order to attain said marker and complete said traction cycle;

e) positioning of said swimmer's hand on or near said marker or said lateral step like member which supports said marker;

f) completion of said traction cycle;

g) anticipation of the next marker.

22. A method as claimed in claim 21, wherein step e) involves the positioning of said swimmer's hand near said marker and said lateral step like member without physically touching them.

* * * * *